US007231718B2

(12) United States Patent
Outen

(10) Patent No.: US 7,231,718 B2
(45) Date of Patent: Jun. 19, 2007

(54) MULTI-POSITION LOCKING TOOL

(76) Inventor: James Timothy Outen, 8022 Indian Trail-Fairview Rd., Indian Trail, NC (US) 28079

( * ) Notice: Subject to any disclaimer, the term of this patent is extended or adjusted under 35 U.S.C. 154(b) by 137 days.

(21) Appl. No.: 11/045,597

(22) Filed: Jan. 28, 2005

(65) Prior Publication Data

US 2006/0168818 A1 Aug. 3, 2006

(51) Int. Cl.
*B26B 1/02* (2006.01)
*B26B 29/02* (2006.01)

(52) U.S. Cl. ..... 30/161; 30/155; 30/158; 30/160; 30/330; 81/177.1; 81/177.2

(58) Field of Classification Search ..... 30/161, 30/159, 160, 155, 158, 156, 154, 162, 164, 30/329, 330, 331, 340, 342, 321, 319, 307, 30/286, 519; D22/1, 118; D8/99, 101, 98; 403/92, 93, 96; 81/177.1, 177.2
See application file for complete search history.

(56) References Cited

U.S. PATENT DOCUMENTS

| | | | | | |
|---|---|---|---|---|---|
| 401,549 | A | | 4/1889 | Gemrig | |
| 512,965 | A | | 1/1894 | Hoyez | |
| 576,862 | A | | 2/1897 | Lebold | |
| 900,339 | A | | 10/1908 | Woodruff | |
| 1,252,486 | A | | 1/1918 | Paulson | |
| 1,667,462 | A | | 4/1928 | Logan | |
| 1,782,901 | A | | 11/1930 | Kassel | |
| 2,621,689 | A | * | 12/1952 | Fordon | 30/519 |
| 2,921,773 | A | * | 1/1960 | Hoelzer | 254/129 |
| 3,942,249 | A | * | 3/1976 | Poehlmann | 30/160 |
| 4,100,677 | A | * | 7/1978 | Jeff | 30/321 |
| 4,170,061 | A | | 10/1979 | Henry | |
| 4,177,560 | A | * | 12/1979 | Sakurai | 30/160 |
| 4,227,303 | A | | 10/1980 | Brooker | |
| 4,242,795 | A | | 1/1981 | Rollband et al. | |
| 4,272,887 | A | * | 6/1981 | Poehlmann | 30/161 |
| 4,541,175 | A | | 9/1985 | Boyd et al. | |
| 4,730,394 | A | * | 3/1988 | Sonner, Jr. | 30/161 |
| 4,750,267 | A | * | 6/1988 | Boyd | 30/161 |
| 4,893,409 | A | * | 1/1990 | Poehlmann | 30/161 |
| 4,974,323 | A | | 12/1990 | Cassady | |
| 5,092,045 | A | | 3/1992 | Boyd, Jr. et al. | |
| 5,327,651 | A | * | 7/1994 | Favreau | 30/161 |
| 5,722,168 | A | | 3/1998 | Huang | |
| 5,839,194 | A | | 11/1998 | Bezold | |
| 5,943,925 | A | * | 8/1999 | Huang | 81/177.2 |

(Continued)

*Primary Examiner*—Boyer D. Ashley
*Assistant Examiner*—Ghassem Alie
(74) *Attorney, Agent, or Firm*—Adams Evans P. A.

(57) ABSTRACT

A locking tool includes a handle and an elongated tool blade having a body and a tang. The tool blade has a tang spline opening formed therein which defines an annular array of alternate spline teeth and splined slots. A transversely-extending lock member has a spline ring with an annular array of alternate spline ribs and spline grooves formed thereon complementary to the tang spline opening, and is translatable between a locked position and a released position. The tool blade is attached to the handle by the locking member such that when the lock member is in the released position, the tool blade is freely pivotable about the locking member. When the lock member is in the locked position, the spline ring engages the tang spline opening such that the tool blade is retained in one of a plurality of predetermined angular positions relative to the handle.

5 Claims, 16 Drawing Sheets

U.S. PATENT DOCUMENTS 5,964,035 A * 10/1999 Poehlmann ..... 30/161
6,134,788 A 10/2000 Chen et al.
6,186,033 B1 * 2/2001 Faro, Sr. ..... 81/177.7
6,378,214 B1 4/2002 Onion
6,446,341 B1 * 9/2002 Wang et al. ..... 30/125
6,460,254 B1 10/2002 Mori et al.
6,591,505 B2 7/2003 Flavigny
6,848,344 B2 * 2/2005 Rocco ..... 81/177.8
7,093,367 B1 * 8/2006 Huang ..... 30/519

* cited by examiner

MULTI-POSITION LOCKING TOOL

BACKGROUND OF THE INVENTION

This invention relates generally to a folding tool, and more particularly to a folding knife which locks in multiple positions.

Folding tools, particularly including knifes and other cutting implements, are well known. A folding knife typically includes a blade which is pivotally mounted to a handle so that it can swing between an open position and a closed position in which the cutting edge is covered by the handle to protect both the user from injury and the blade from damage. It is also known to provide such knives with a lock to prevent inadvertent closing of the blade during use. However, such locks fail to provide both multiple positions and easy release of the blade.

Accordingly, there is a need for a folding tool which can be securely locked into a plurality of positions.

BRIEF SUMMARY OF THE INVENTION

The above-mentioned need is met by the present invention, which according to one aspect provides a folding tool, including: a handle having front and rear ends; an elongated tool blade having a body and a tang, the tool blade having a tang spline opening formed therein which defines an annular array of alternate spline teeth and splined slots; and a transversely-extending lock member having a spline ring with an annular array of alternate spline ribs and spline grooves formed thereon complementary to the tang spline opening, the lock member translatable between a locked position and a released position The tool blade is attached to the handle by the locking member such that when the lock member is in the released position, the tool blade is freely pivotable about the locking member, and when the lock member is in the lock position, the spline ring engages the tang spline opening such that the tool blade is retained in one of a plurality of predetermined angular positions relative to the handle.

According to another aspect of the invention, the folding tool further includes a spring which urges the lock member towards the locked position.

According to another aspect of the invention, the tool blade is a knife blade having a cutting edge.

According to another aspect of the invention, the handle includes at least one spline opening disposed coaxially with the lock member, the spline opening having an annular array of alternate spline teeth and spline slot formed thereon complementary to the lock ring, wherein the spline opening engages the spline ring when the lock member is in the locked position.

According to another aspect of the invention the handle includes spaced-apart left and elongated frames, and each of the frames includes a frame spline opening having an annular array of alternate spline teeth and spline slot formed thereon complementary to the spline ring.

According to another aspect of the invention, the spline ring of the lock member engages each of the frame spline openings when the lock member is in the locked position.

According to another aspect of the invention, the locking member includes two spaced-apart spline rings each having an annular array of alternate spline ribs and spline grooves formed thereon complementary to the tang spline opening, wherein one of the spline rings engages one of the frame spline openings, and the other of the spline rings engages the other of the frame spline openings, when the lock member is in the locked position.

According to another aspect of the invention, a folding tool includes: a handle including a pair of spaced-apart left and right frames each having front and rear ends, wherein at least one of the frames includes a frame spline opening disposed at the front end thereof, the spline opening having an annular array of alternate spline teeth and spline slot formed thereon; an elongated tool blade having a body and a tang, the tool blade having a tang spline opening formed therein which defines an annular array of alternate spline teeth and splined slots identical to the spline opening; and a transversely-extending lock member. The lock member includes: at least one having a spline ring with an annular array of alternate spline ribs and spline grooves formed thereon complementary to the tang spline opening and the spline opening; and at least one central shaft having a cylindrical outer surface, wherein the lock member is disposed between the left and right frames such that the spline ring engages at least one of the frame spline openings. The lock member is translatable between a locked position and a released position. The tool blade is attached to the handle by the locking member such that when the lock member is in the released position, the tool blade is freely pivotable about the central shaft of the locking member, and when the lock member is in the lock position, the spline ring engages the tang spline opening such that the tool blade is retained in one of a plurality of predetermined angular positions relative to the handle.

According to another aspect of the invention, the folding tool further includes a spring which urges the lock member towards the locked position.

According to another aspect of the invention, the spring is carried between the lock member and a side plate which covers one of the spline openings.

According to another aspect of the invention, each of the frames includes a frame spline opening having an annular array of alternate spline teeth and spline slot formed thereon complementary to the spline ring.

According to another aspect of the invention, the spline ring of the lock member engages both of the frame spline openings when the lock member is in the locked position.

According to another aspect of the invention, the locking member includes two spaced-apart spline rings each having an annular array of alternate spline ribs and spline grooves formed thereon complementary to the tang spline opening, wherein one of the spline rings engages one of the frame spline openings, and the other of the spline rings engages the other of the frame spline openings, when the lock member is in the locked position.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
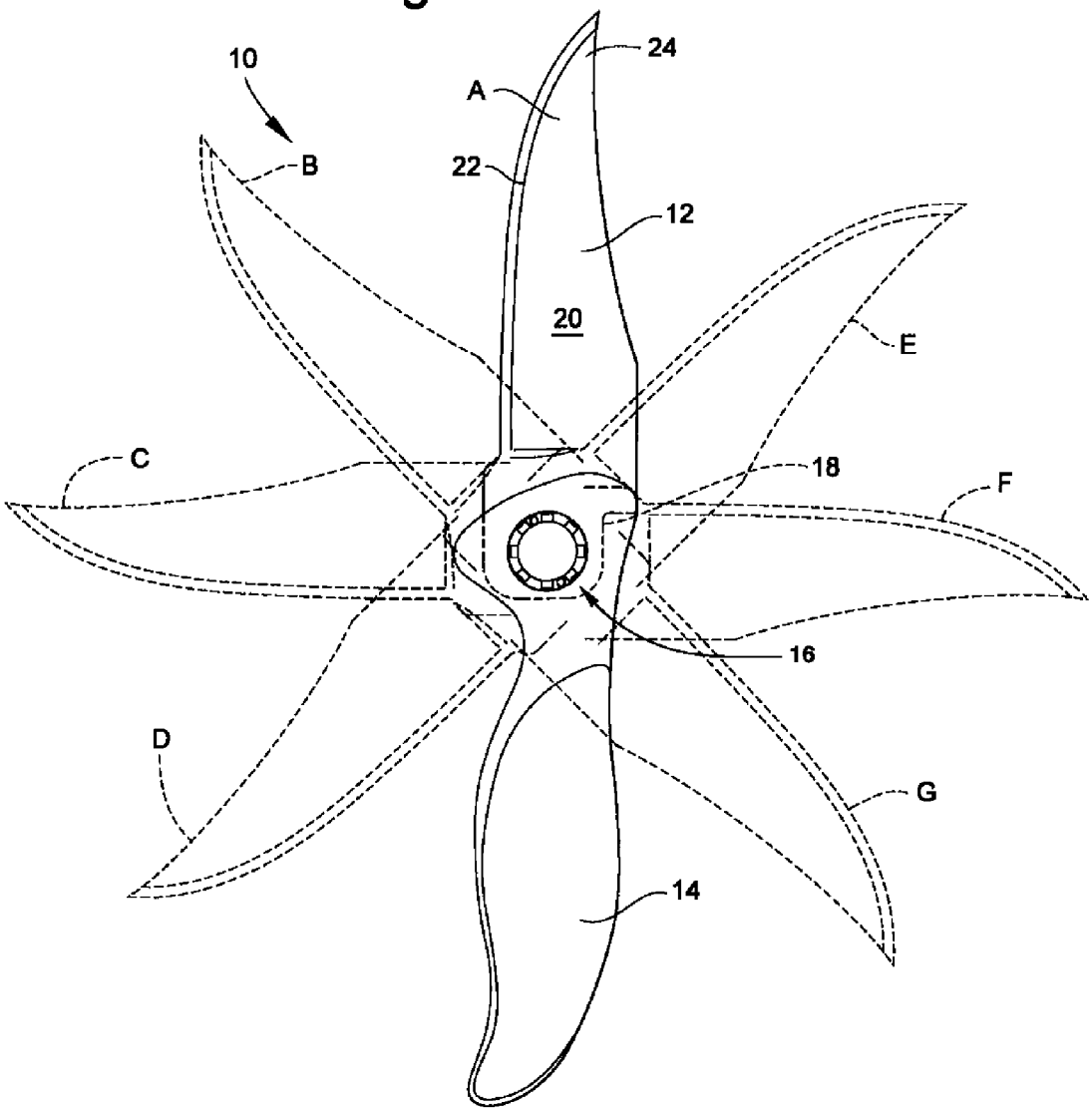
FIG. 1 is a side view of an exemplary folding tool constructed according to the present invention.
Figure 5:
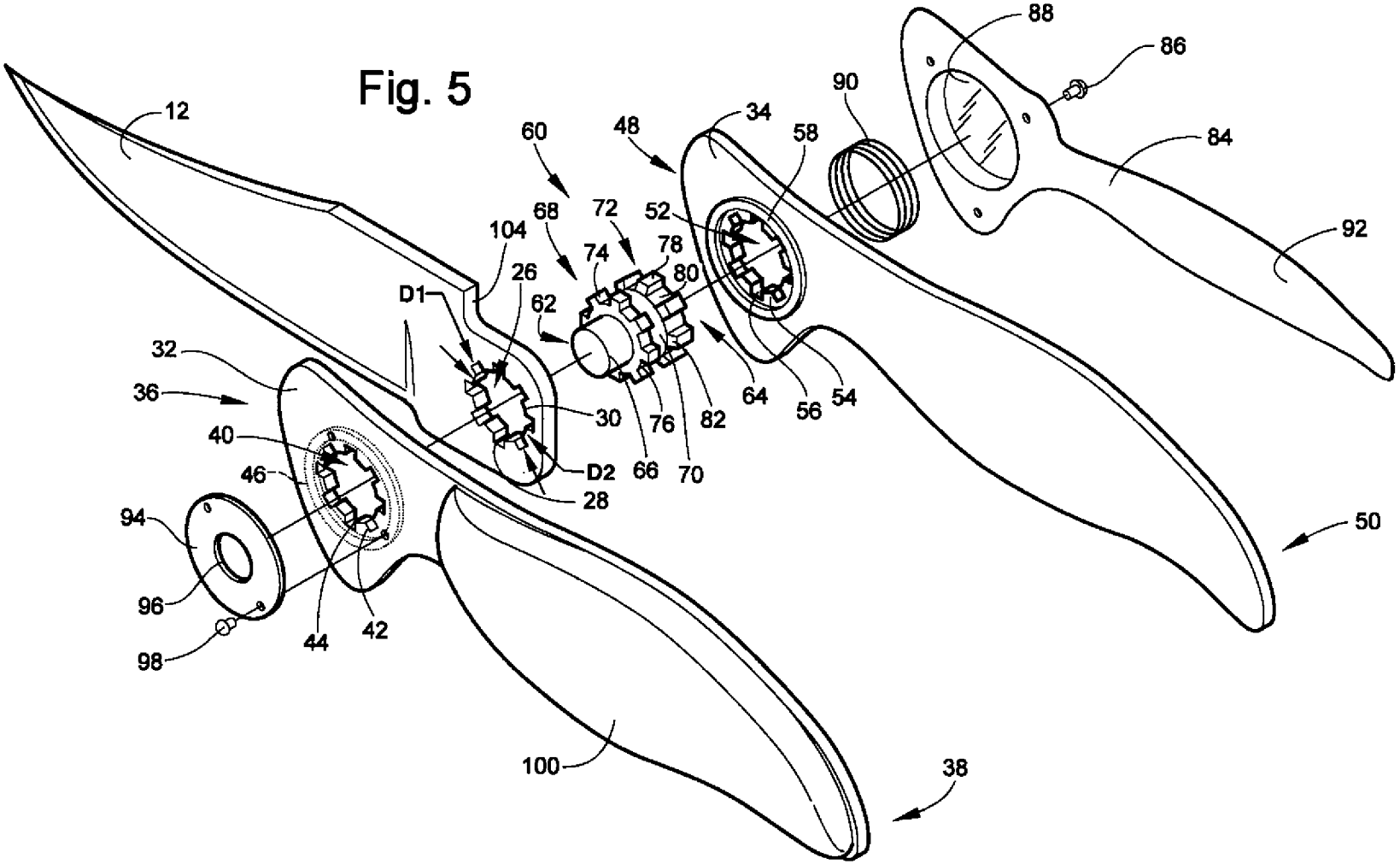
FIG. 5 is an exploded perspective view showing the components of the folding tool of FIG. 1.

Referring to the drawings wherein identical reference numerals denote the same elements throughout the various views, FIG. 1 illustrates a representative folding tool, generally designated 10, constructed according to an embodiment of the present invention. The basic components of the folding tool 10 are a tool blade 12, a handle 14, and a locking mechanism 16. In the illustrated example, the tool blade 12 is a knife blade having an inner end or tang 18, a body 20, an elongated cutting edge 22, and a pointed distal end 24 disposed opposite the tang 18. As shown in FIG. 5, a tang spline opening 26 is formed in the tang 18. The tang spline opening 26 includes a circumferential array of spline slots 28 which define an outer diameter D1. The tang spline slots 28 alternate with radially-inwardly extending tang spline teeth 30 that define an inner diameter D2.

The handle 14 comprises left and right frames 32 and 34, respectively. The construction of the left and right frames 32 and 34 may be substantially similar in dimensions and material to prior art folding tools. For example, the left and right frames 32 and 34 may be formed from stamped or machined steel. The left frame 32 is generally planar and has a forward end 36 and a rear end 38. The left frame 32 has a left frame spline opening 40 formed therein at the front end 36. The left frame spline opening 40 is substantially the same in size and shape to the tang spline opening 26, and includes alternating spline teeth 42 and spline slots 44. A raised, inwardly-protruding left bearing ring 46, the purpose of which is explained below, is formed around the left frame spline opening 40.

The right frame 34 is generally planar and has a front end 48 and a rear end 50. The right frame 34 has a right frame spline opening 52 formed therein at the front end 48. The right frame spline opening 52 is substantially the same in size and shape to the tang spline opening 26, and includes spline teeth 54 and alternating spline slots 56. A raised, inwardly-protruding right bearing ring 58, the purpose of which is explained below, is formed around the right frame spline opening 52.

A lock member 60 is provided which is a generally cylindrical member having a left end 62 and a right end 64. The lock member 60 includes, in left-to-right order, a cylindrical release button 66, a left spline ring 68, a central shaft 70, and a right spline ring 72. The lock member 60 may be integrally formed from steel or a similar material. The release button 66 has an outside diameter smaller than the inside diameter D2 of the tang spline opening 26. If desired, the release button 66 may include a reduced diameter portion (not shown) specifically for being pressed by a user. This may be more aesthetically pleasing than a large diameter button. The left spline ring 68 includes a circumferential array of left spline ribs 74 which define an outer diameter slightly smaller than the outer diameter D1. The left spline ribs 74 alternate with radially-inwardly extending left spline grooves 76 that define an inner diameter slightly smaller than the inner diameter D2. The central shaft 70 has an outer diameter slightly smaller than the inner diameter D2. The right spline ring 72 includes a circumferential array of right spline ribs 78 which define an outer diameter slightly smaller than the outer diameter D1. The right spline ribs 78 alternate with radially-inwardly extending right spline grooves 80 that define an inner diameter slightly smaller than the inner diameter D2. Chamfered surfaces, shown in exemplary form at 82, may be provided at the ends of the spline ribs 78 to ease operation of the lock member 60.

The folding tool 10 is assembled as follows. The lock member 60 is inserted into the right frame 34 so that the right spline ring 72 engages the right frame spline opening 52. A right side plate 84 is attached to the outside of the right frame 34 with the illustrated rivets 86 or other suitable means. The right side plate 84 includes a cup 88 which covers the right spline opening 52 and retains a spring 90, such as the illustrated coil spring, between the right frame 34 and the right side plate 84. In the illustrated example, the right side plate 84 is a unitary member which comprises both the cup 88 and a spring clip 92 (see FIG. 2) suitable for holding the folding tool 10 to a user's pocket or belt.

The tang spline opening 26 of the tool blade 12 fits over the lock member 60. The left frame spline opening 40 fits over the lock member 60 as well. A retainer plate 94 fits over the outer surface of the left frame 32 to retain the lock member 60 in position. The retainer plate 94 is attached to the left frame 32 by the illustrated rivets 98 or other suitable means, and includes an opening 96 therein through which the release button 66 passes. A left side plate 100 is attached to the left frame 32 as well. It may be made of a material suitable for decorative or grip-enhancing purposes, such as rubber, plastic, wood, etc.

Figure 2:
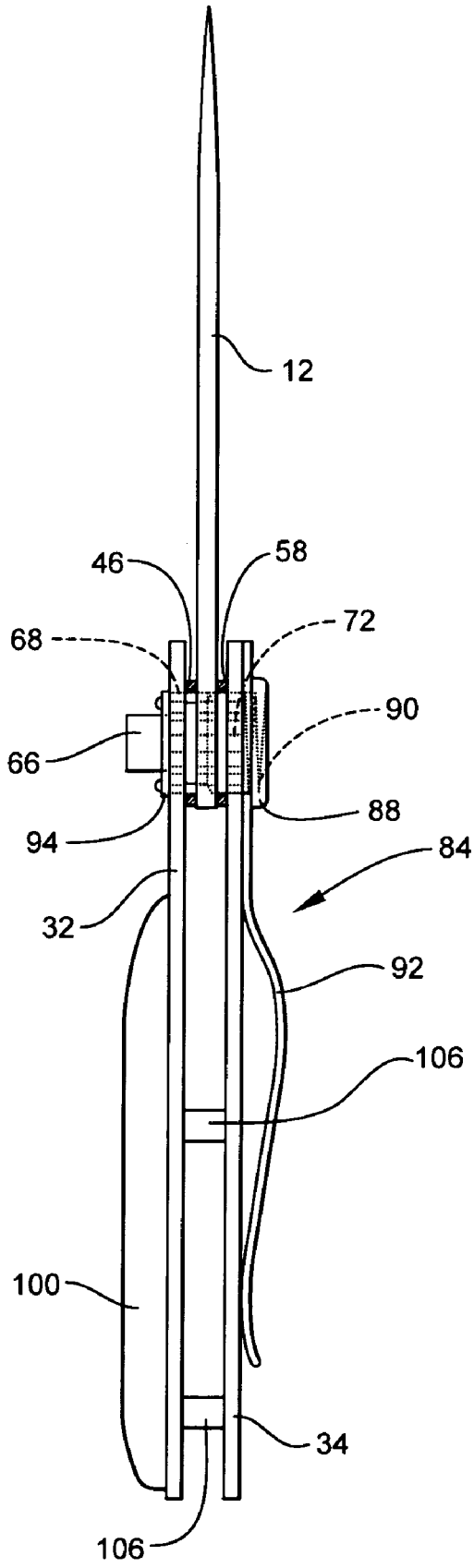
FIG. 2 is a top view of the folding tool of FIG. 1.
Figure 4:
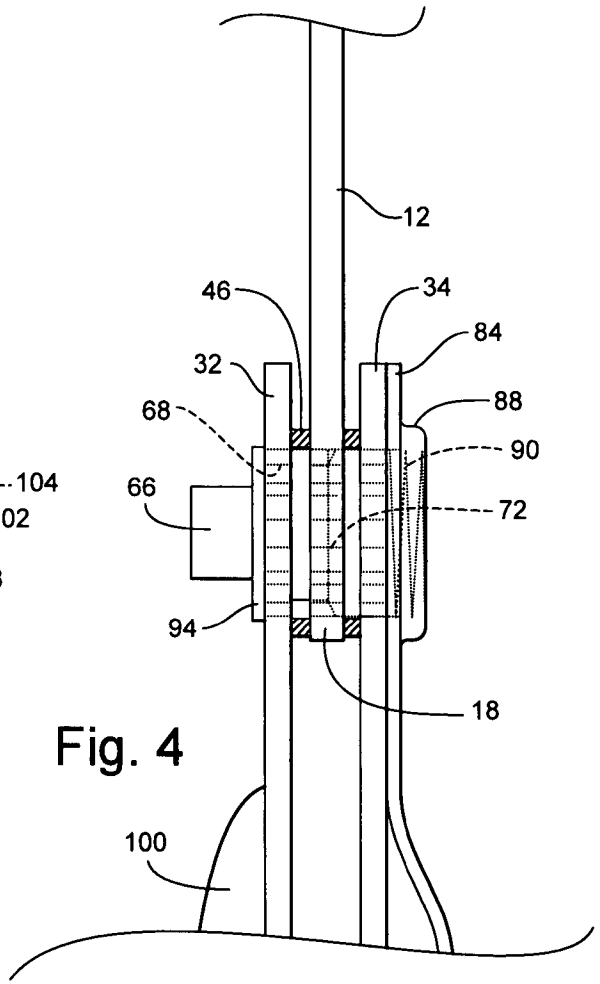
FIG. 4 is a top view of the locking mechanism shown in FIG. 3.
Figure 3:
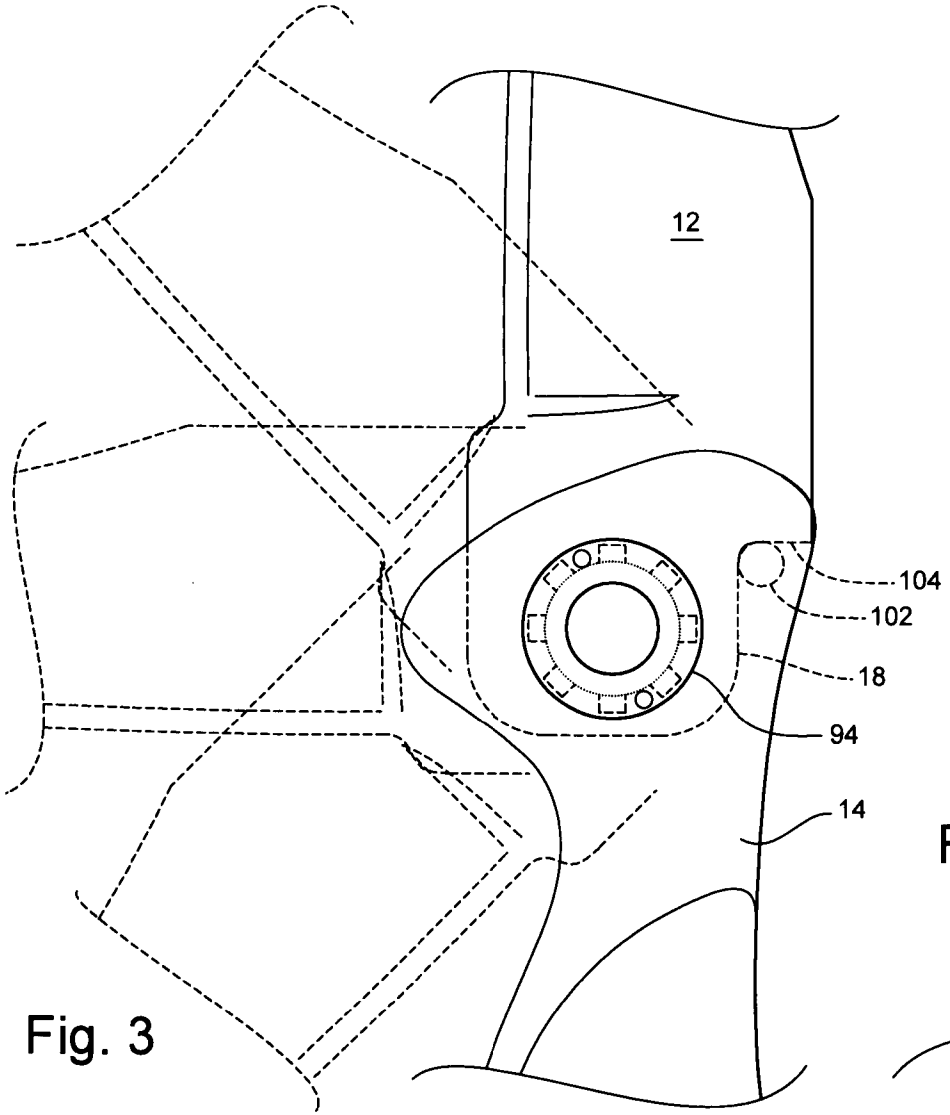
FIG. 3 is an enlarged side view of FIG. 2 showing a locking mechanism of the folding tool in greater detail.

FIGS. 2, 3, and 4 show the folding tool 10 in the assembled condition, with the tool blade 12 clamped tightly between the left and right bearing rings 46 and 58 to prevent wobbling or lateral movement. It is noted that the bearing rings 46 and 58 need not be distinct ring-like structures as shown. For example, the thickness of the left and right frames 32 and 34 could simply be increased to bear against the sides of the tool blade 12. An optional stop pin 102 extends laterally between the left and right frames 32 and 34 and engages an optional step 104 in the tang 18 to provide a bearing point for the tool blade 12 in a fully opened position. The left and right frames 32 and 34 are attached to each other by suitable means such as the plurality of struts 106.

In the locked position, shown in FIG. 4, the spring 90 urges the lock member 60 leftwards so that the release button 66 protrudes through the opening 96 in the retainer plate 94. The left spline ribs 74 and left spline grooves 76 of the left spline ring 68 engage the spline slots 44 and spline teeth 42, respectively, of the left frame spline opening 40. The right spline ribs 78 and right spline grooves 80 of the right spline ring 72 engage the spline slots 28 and spline teeth 30, respectively, of the tang spline opening 26, and also engage the spline slots 56 and spline teeth 54, respectively, of the right frame spline opening 52. In this condition, the tool blade 12 is solidly locked against pivoting motion in either the open or closed directions.

The tool blade 12 is released by depressing the release button 66, moving the lock member 60 to the right against the spring 90. This causes the left spline ring 68 to disengage the left frame spline opening 40, and the right spline ring 72 to disengage the tang spline opening 26. The spline teeth 30 of the tang spline opening 26 thus ride on the central shaft 70. In this condition a user can freely swing the tool blade 12 inwards or outwards to the desired position. The user keeps the release button 66 depressed until the tool blade 12 is disposed at or near the correct angular position, and then releases the release button 66. The spring 90 urges the lock member 60 leftwards. As the tool blade 12 is brought into alignment at the desired working position, the lock member 60 moves fully to the locked position, described above. The tool blade 12 is thus locked against any further pivoting motion until the release button 66 is again depressed, and the user may safely work with the folding tool 10 knowing that the tool blade 12 will neither open further nor close accidentally.

As shown in FIG. 1, the tool blade 12 can be locked in a number of different positions, represented by dashed lines. In the illustrated example there are eight locking positions including "fully" open (i.e. parallel to the handle 14), shown at "A", open 135°, shown at "B", open 90°, shown at "C", open 45°, shown at "D", and fully closed (not shown). If the stop pin 102 is not used the tool blade 12 can be locked in additional positions around a full circle. Examples of these positions are shown at "E", "F", and "G". The number of positions as well as the angular orientation of each position may be varied to suit a particular application by suitable modification of the lock member 60, tang spline opening 26, left frame spline opening 40, and right frame spline opening 52. These positions greatly add to the utility of the folding tool 10. Of course, the folding tool 10 may be used in a conventional manner when the tool blade 12 is at position A or fully closed. When the tool blade 12 is placed in positions B or C, is it useful for making cuts on vertical or horizontal surfaces while placing the user's hand in a comfortable position. Finally, when placed in position D, the tool blade 12 may be used to make cuts while preventing unwanted damage or injury. For example, in this position, the tool blade 12 may be used to cut carpeting without damaging the subflooring, or to sever a seat belt in the event of a car accident.

Figure 9:
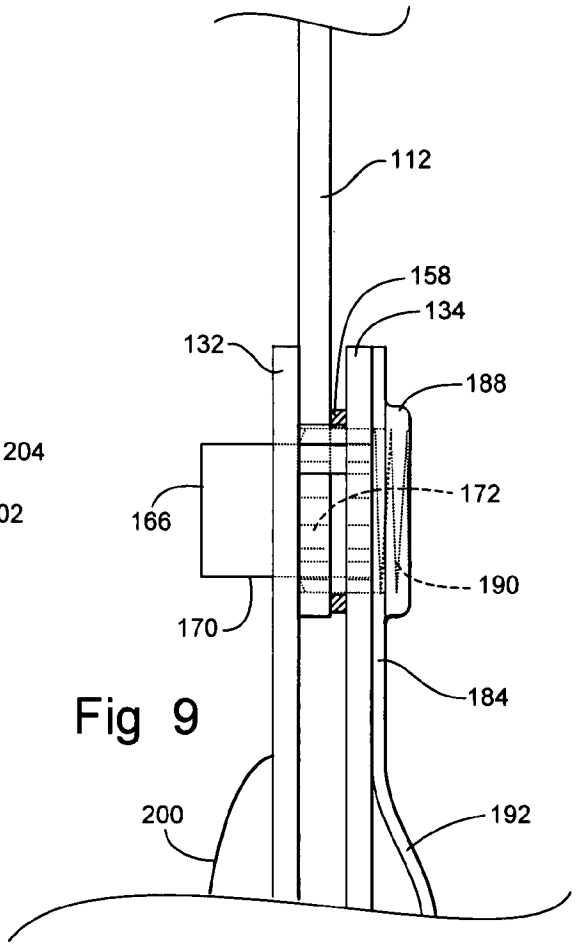
FIG. 9 is a top view of the locking mechanism shown in FIG. 9.
Figure 10:
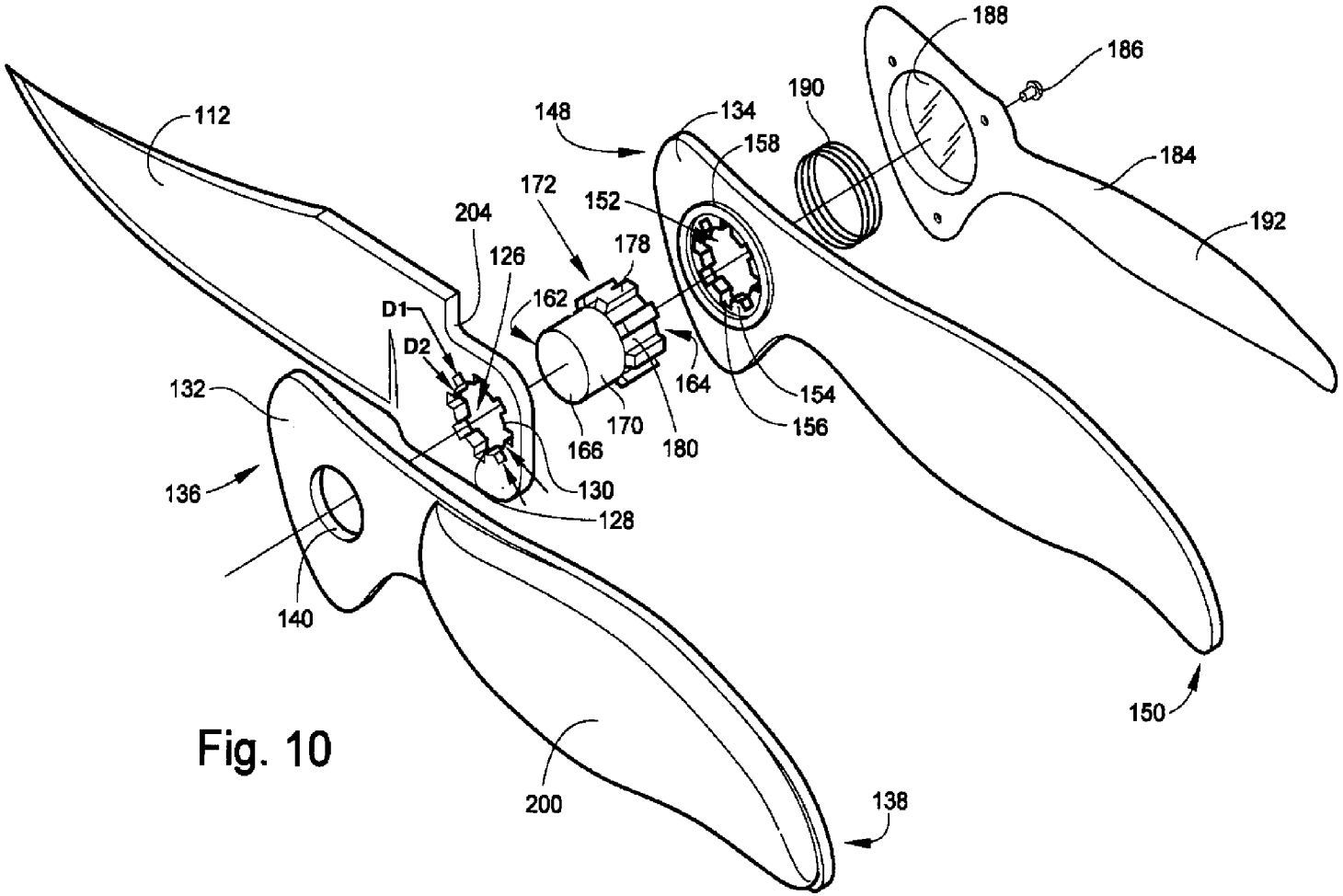
FIG. 10 is an exploded perspective view showing the components of the folding tool of FIG. 6.

FIGS. 6-10 illustrate an alternative folding tool 110. The folding tool 110 is substantially similar to the folding tool 10 described above and has a tool blade 112, a handle 114, and a locking mechanism 116. It differs from the folding tool 10 principally in the design of the locking mechanism 116. In the illustrated example, the tool blade 112 is a knife blade having an inner end or tang 118, a body 120, an elongated cutting edge 122, and a pointed distal end 124 disposed opposite the tang 118. As shown in FIG. 10, a tang spine opening 26 is formed in the tang 118. The tang spline opening 26 includes a circumferential array of spline slots 128 which define an outer diameter D1. The tang spline slots 128 alternate with radially-inwardly extending tang spline teeth 130 that define an inner diameter D2.

The handle 114 comprises left and right frames 132 and 134, respectively. The construction of the left and right frames 132 and 134 may be substantially similar in dimensions and material to prior art folding tools. For example, the left and right frames 132 and 134 may be formed from stamped or machined steel. The left frame 132 is generally planar and has a front end 136 and a rear end 138. The left frame 132 has a left frame opening 140 formed therein at the front end 136.

The right frame 134 is generally planar and has a front end 148 and a rear end 150. The right frame 134 has a right frame spline opening 152 formed therein at the front end 148. The right frame spline opening 152 is substantially the same in size and shape to the tang spline opening 26, and includes spline teeth 154 and alternating spline slots 156. A raised, inwardly-protruding right bearing ring 158, the purpose of which is explained below, is formed around the right frame spline opening 152.

A lock member 160 is provided which is a generally cylindrical member having a left end 162 and a right end 164. The lock member 160 includes, in left-to-right order, a release button 166 disposed at the end of a central shaft 170, and a spline ring 172. The lock member 160 may be integrally formed from steel or a similar material. The central shaft 170 has an outer diameter slightly smaller than the inner diameter D2. The spline ring 172 includes a circumferential array of spline ribs 178 which define an outer diameter slightly smaller than the outer diameter D1. The spline ribs 178 alternate with radially-inwardly extending spline grooves 180 that define an inner diameter slightly smaller than the inner diameter D2. Chamfered surfaces, shown in exemplary form at 182, may be provided at the ends of the spline ribs 178 to ease operation of the lock member 160.

The folding tool 110 is assembled as follows. The lock member 160 is inserted into the right frame 134 so that the spline ring engages the right spline opening 152. A right side plate 184 is attached to the outside of the right frame 134 with the illustrated rivets 186 or other suitable means. The right side plate 184 includes a cup 188 which covers the right spline opening 152 and retains a spring 190, such as the illustrated coil spring, between the right frame 134 and the right side plate 184. In the illustrated example, the right side plate 184 is a unitary member which comprises both the cup 188 and a spring clip 192 (see FIG. 7) suitable for holding the folding tool 110 to a user's pocket or belt.

The tang spline opening 126 of the tool blade 112 fits over the lock member 160. The left frame opening 140 fits over the release button 166 and central shaft 170 of the lock member 160 to retain the lock member 160 in position. A left side plate 200 is attached to the left frame 132 as well. It may be made of a material suitable for decorative or grip-enhancing purposes, such as rubber, plastic, wood, etc.

Figure 7:
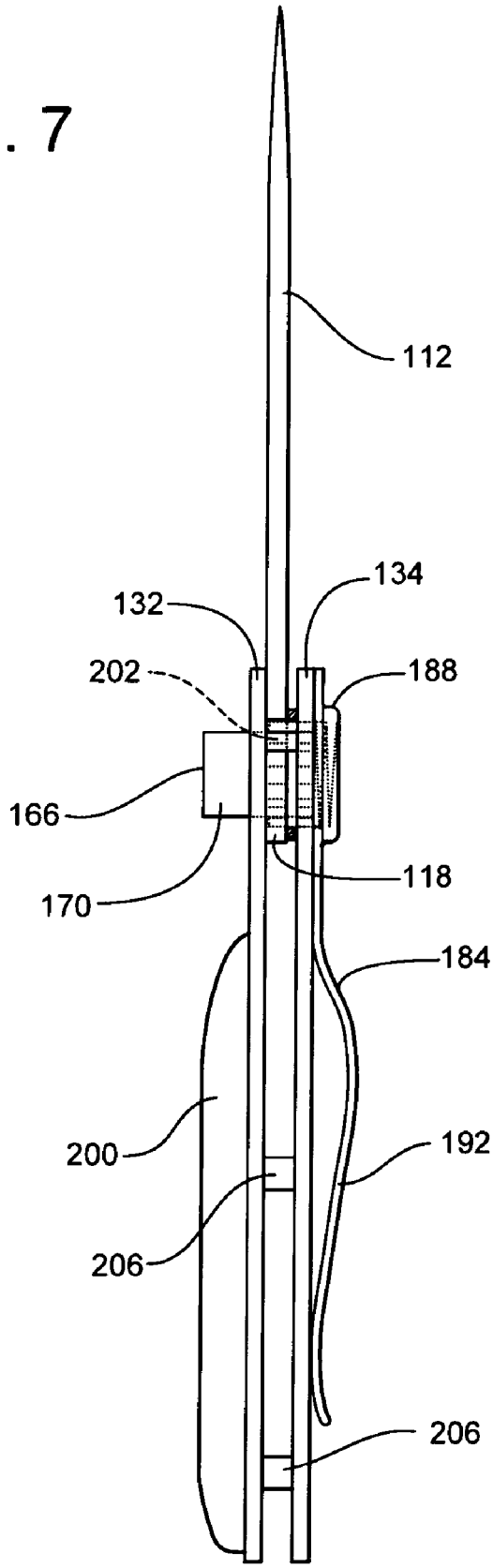
FIG. 7 is a top view of the folding tool of FIG. 6.
Figure 8:
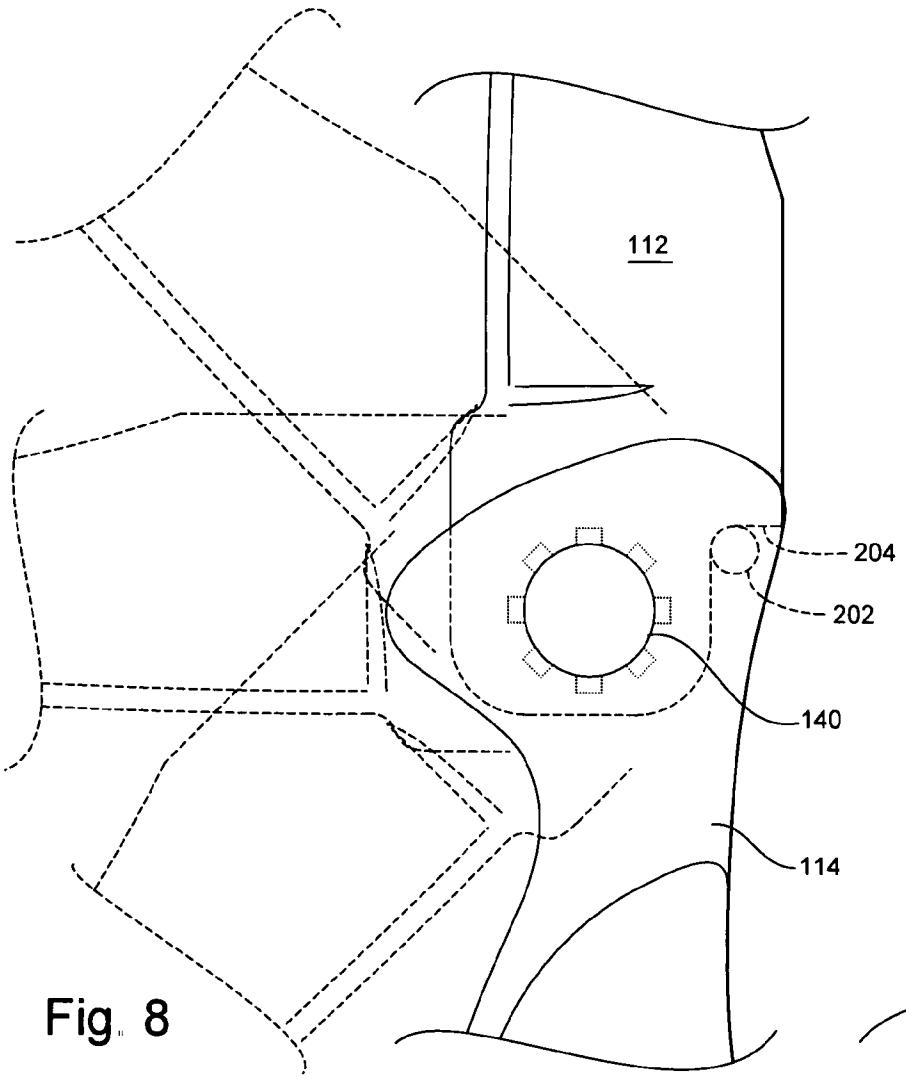
FIG. 8 is an enlarged side view of FIG. 7 showing a locking mechanism of the folding tool in greater detail.

FIGS. 7, 8, and 9 show the folding tool 110 in the assembled condition, with the tool blade 112 clamped tightly between the left frame 132 and right bearing ring 158 to prevent wobbling or lateral movement. It is noted that the bearing ring 158 need not be a distinct ring-like structure as shown. For example, the thickness of the right frame 134 could simply be increased to bear against the side of the tool blade 12. An optional stop pin 202 extends laterally between the left and right frames 132 and 134 and engages an optional step 204 in the tang 118 to provide a bearing point for the tool blade 112 in a fully opened position. The left and right frames 132 and 134 are attached to each other by suitable means such as the plurality of struts 206.

In the locked position, shown in FIG. 9, the spring 190 urges the lock member 160 leftwards so that the release button 166 protrudes through the opening 140 in the left frame 132. The spline ribs 178 and spline grooves 180 of the spline ring 172 engage the spline slots 128 and spline teeth 130, respectively, of the tang spline opening 26, and also engage the spline slots 156 and spline teeth 154, respectively, of the right frame spline opening 152. In this condition, the tool blade 112 is solidly locked against pivoting motion in either the open or closed directions.

The tool blade 112 is released by depressing the release button 166, moving the lock member 160 to the right against the spring 190. This causes the spline ring 172 to disengage the tang spline opening 26. The spline teeth 130 of the tang spline opening 126 thus ride on the central shaft 170. In this condition a user can freely swing the tool blade 112 inwards or outwards to the desired position. The user keeps the release button 166 depressed until the tool blade 112 is disposed at or near the correct angular position, and then releases the release button 166. The spring 190 urges the lock member 160 leftwards. As the tool blade 112 is brought into alignment at the desired working position, the lock member 160 moves fully to the locked position, described above. The tool blade 112 is thus locked against any further pivoting motion until the release button 166 is again depressed, and the user may safely work with the folding tool 110 knowing that the tool blade 112 will neither open further nor close accidentally.

Figure 6:
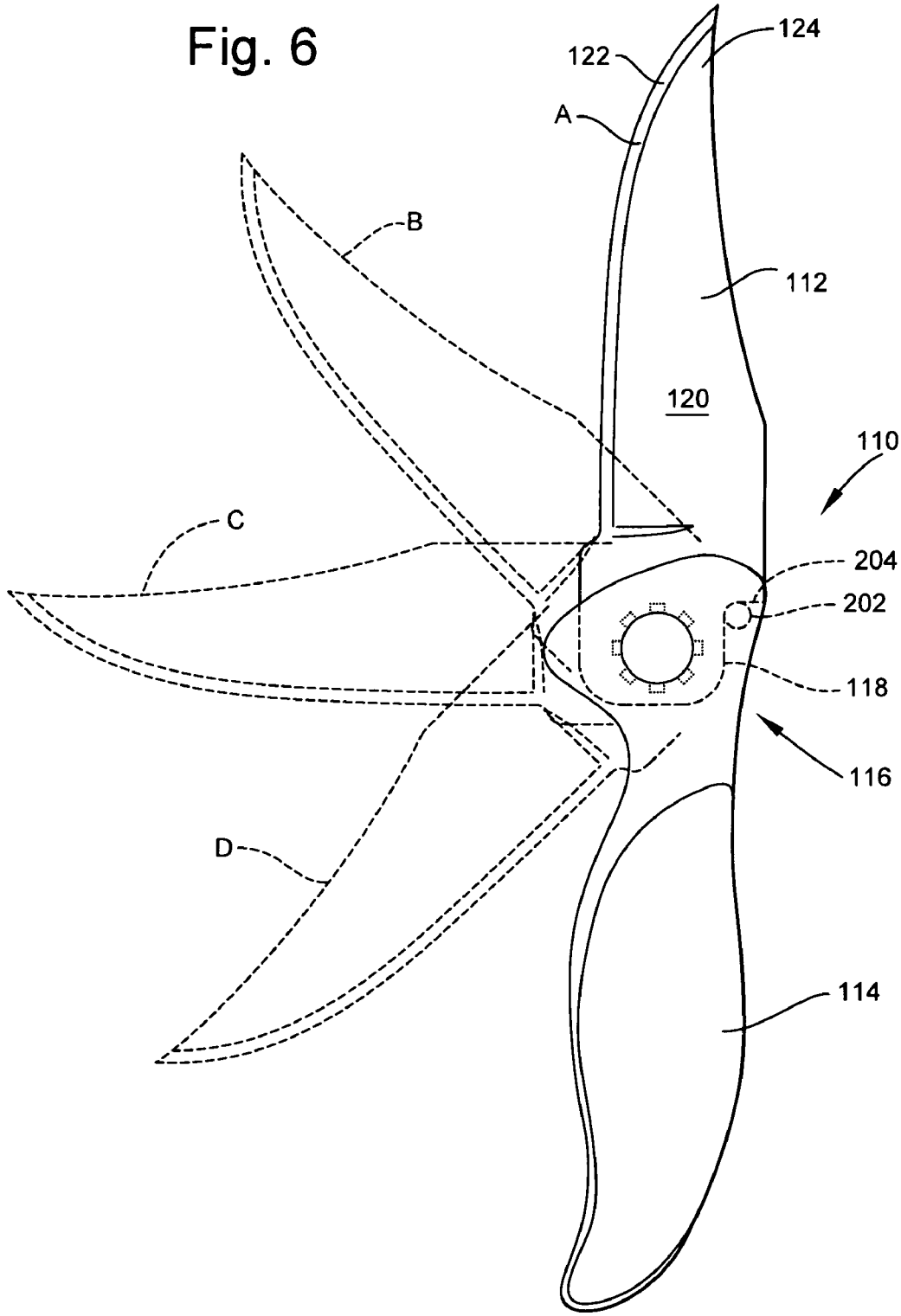
FIG. 6 is a side view of an exemplary folding tool constructed according to an alternative embodiment of the present invention.

As shown in FIG. 6, the tool blade 112 can be locked in a number of different positions, denoted "A" through "D" and represented by dashed lines, in the same manner as for the folding tool 10 described above, and may also be locked in a fully closed position (not shown).

Figure 14:
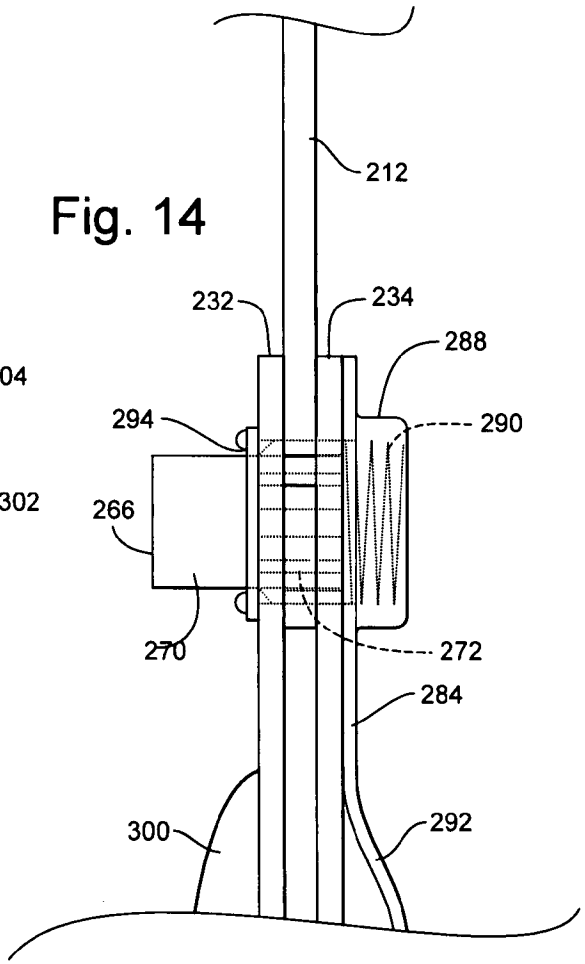
FIG. 14 is a top view of the locking mechanism shown in FIG. 13.
Figure 15:
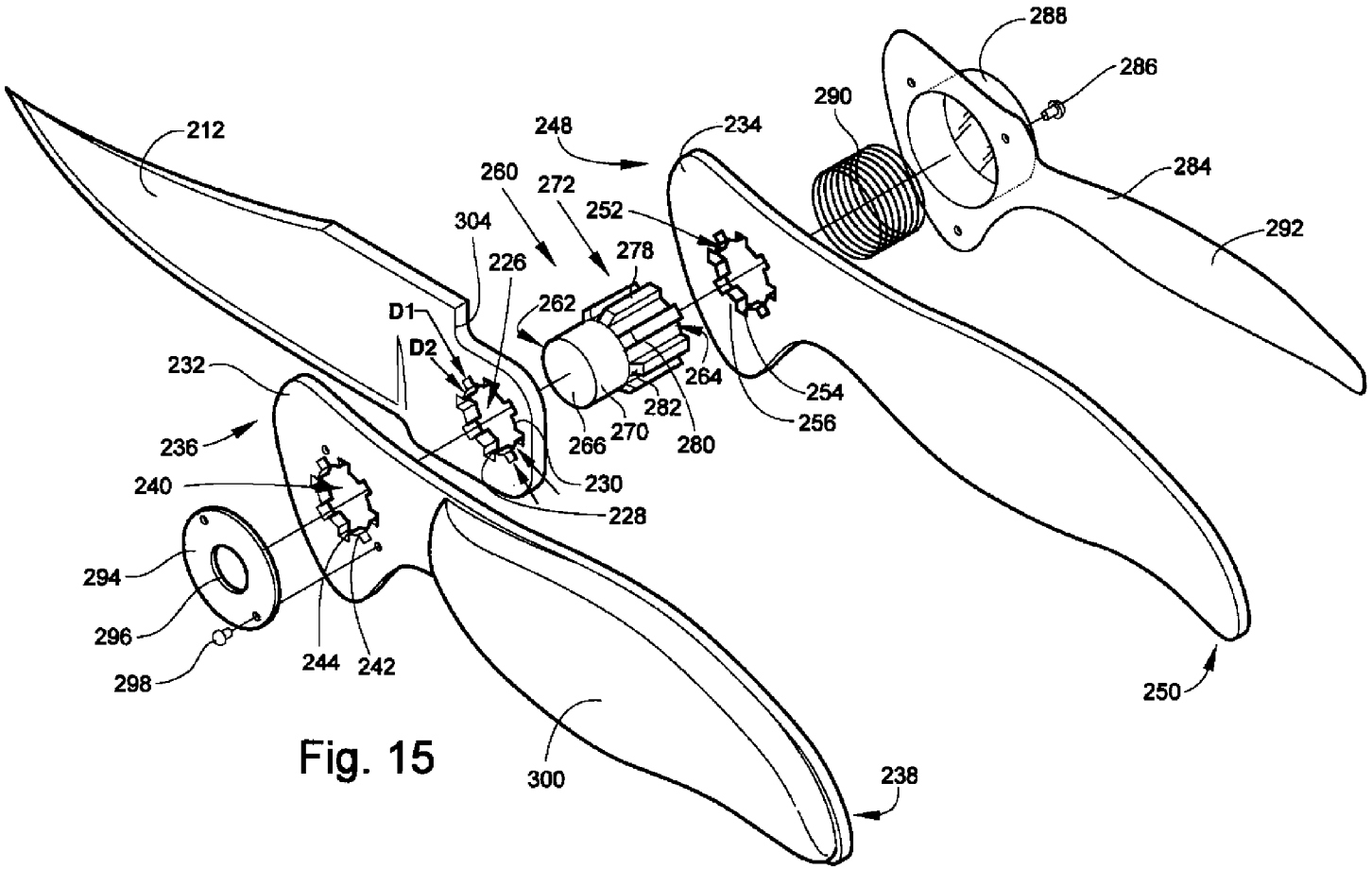
FIG. 15 is an exploded perspective view showing the components of the folding tool of FIG. 11.

FIGS. 10-15 illustrate another alternative folding tool 210. Again, the folding tool 210 is substantially similar to the folding tool 10 described above and has a tool blade 212, a handle 214, and a locking mechanism 216. Like the folding tool 110, it differs from the folding tool 10 principally in the design of the locking mechanism 216. In the illustrated example, the tool blade 212 is a knife blade having an inner end or tang 218, a body 220, an elongated cutting edge 122, and a pointed distal end 124 disposed opposite the tang 218. As shown in FIG. 15, a tang spline opening 226 is formed in the tang 218. The tang spline opening 226 includes a circumferential array of spline slots 228 which define an outer diameter D1. The tang spline slots 228 alternate with radially-inwardly extending tang spline teeth 230 that define an inner diameter D2.

The handle 214 comprises left and right frames 232 and 234, respectively. The construction of the left and right frames 232 and 234 may be substantially similar in dimensions and material to prior art folding tools. For example, the left and right frames 232 and 234 may be formed from stamped or machined steel. The left frame 232 is generally planar and has a front end 236 and a rear end 238. The left frame 232 has a left frame spline opening 240 formed therein at the front end 236. The left frame spline opening 240 is substantially the same in size and shape to the tang spline opening 226, and includes alternating spline teeth 242 and spline slots 244.

The right frame 234 is generally planar and has a front end 248 and a rear end 250. The right frame 234 has a right frame spline opening 252 formed therein at the front end 248. The right frame spline opening 252 is substantially the same in size and shape to the tang spline opening 226, and includes spline teeth 254 and alternating spline slots 256.

A lock member 260 is provided which is a generally cylindrical member having a left end 262 and a right end 264. The lock member 260 includes, in left-to-right order, a release button 266 disposed at the end of a central shaft 170, and a spline ring 272. The lock member 260 may be integrally formed from steel or a similar material. The central shaft 270 has an outer diameter slightly smaller than the inner diameter D2. The spline ring 272 includes a circumferential array of spline ribs 278 which define an outer diameter slightly smaller than the outer diameter D1. The spline ribs 278 alternate with radially-inwardly extending spline grooves 280 that define an inner diameter slightly smaller than the inner diameter D2. Chamfered surfaces, shown in exemplary form at 282, may be provided to ease operation of the lock member 260. The main difference in the lock member 260 and the lock member 160 is that the spline ring 278 is substantially longer than the spline ring 178.

The folding tool 210 is assembled as follows. The lock member 260 is inserted into the right frame 234 so that the spline ring engages the right spline opening 252. A right side plate 284 is attached to the outside of the right frame 234 with the illustrated rivets 286 or other suitable means. The right side plate 284 includes a cup 288 which covers the right spline opening 252 and retains a spring 290, such as the illustrated coil spring, between the right frame 234 and the right side plate 284. In the illustrated example, the right side plate 284 is a unitary member which comprises both the cup 288 and a spring clip 292 (see FIG. 11) suitable for holding the folding tool 210 to a user's pocket or belt.

The tang spline opening 226 of the tool blade 212 fits over the lock member 260. The left frame spline opening 240 fits over the lock member 260 as well. A retainer plate 294 fits over the outer surface of the left frame 232 to retain the lock member 260 in position. The retainer plate 294 is attached to the left frame 232 by the illustrated rivets 298 or other suitable means, and includes an opening therein 296 through which the release button 266 passes. A left side plate 300 is attached to the left frame 232 as well. It may be made of a material suitable for decorative or grip-enhancing purposes, such as rubber, plastic, wood, etc.

Figure 11:
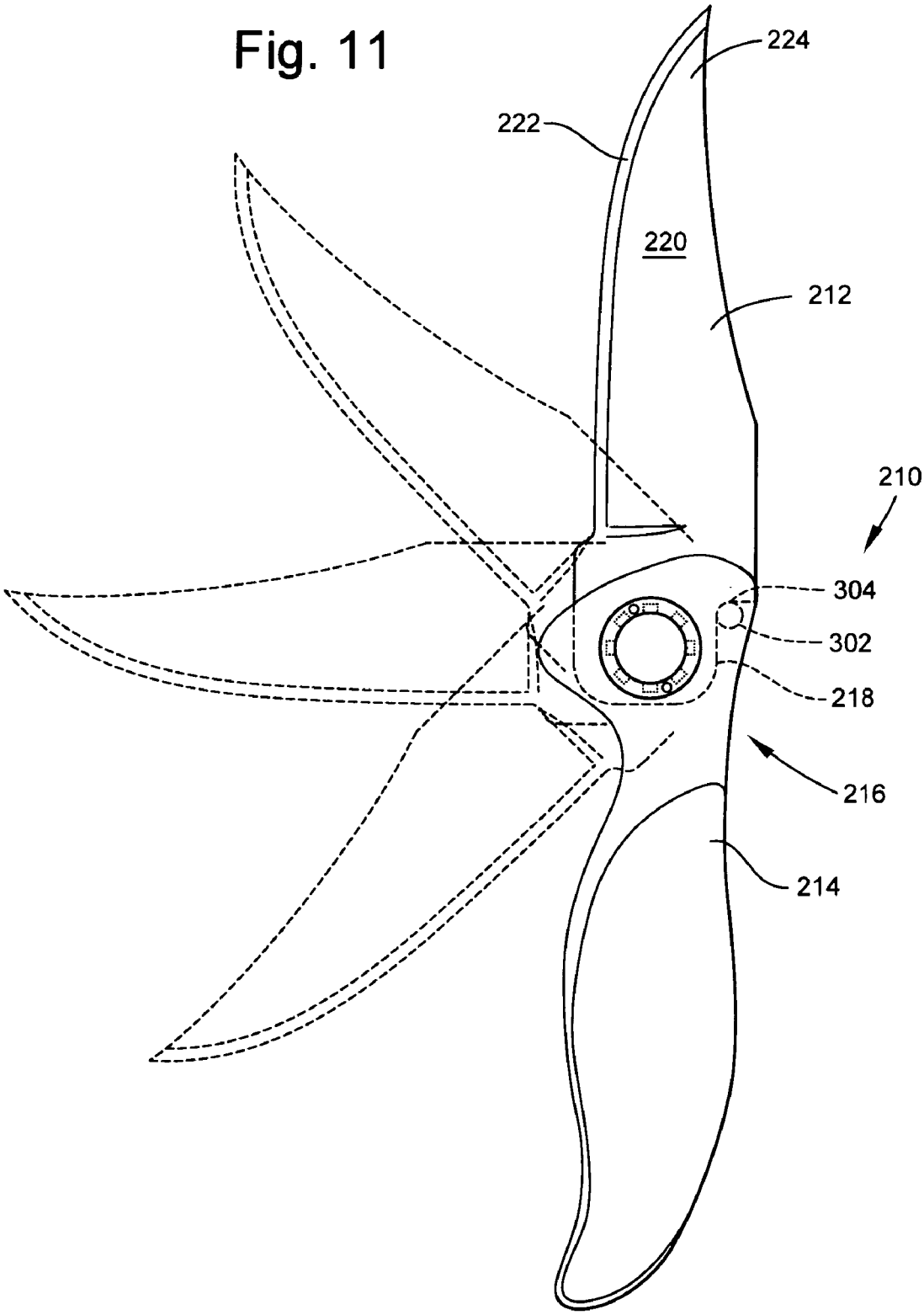
FIG. 11 is a side view of an exemplary folding tool constructed according to an alternative embodiment of the present invention.
Figure 12:
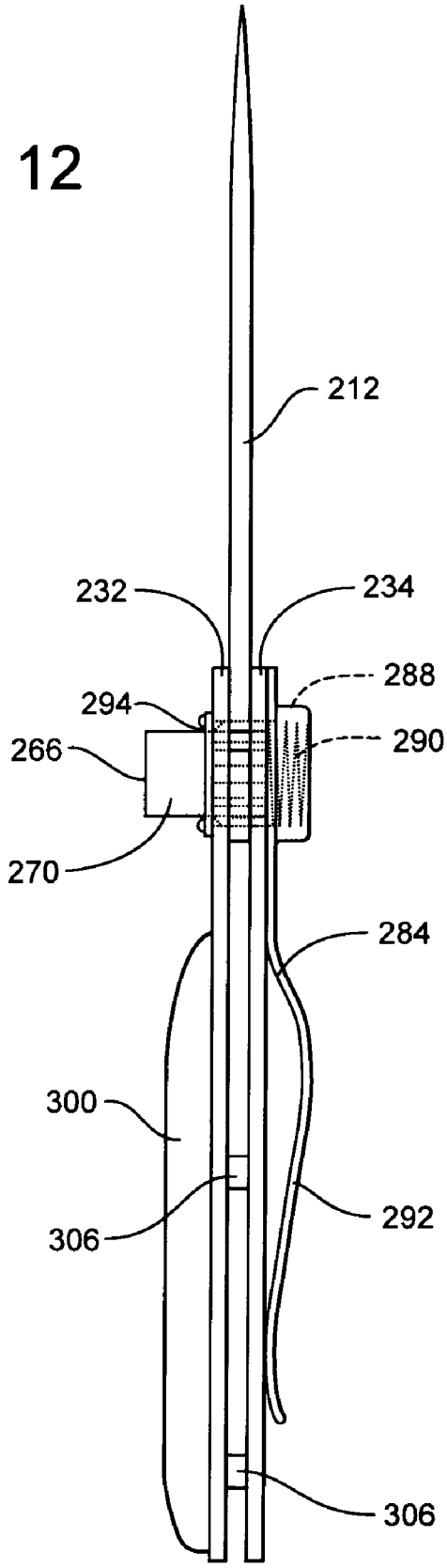
FIG. 12 is a top view of the folding tool of FIG. 11.
Figure 13:
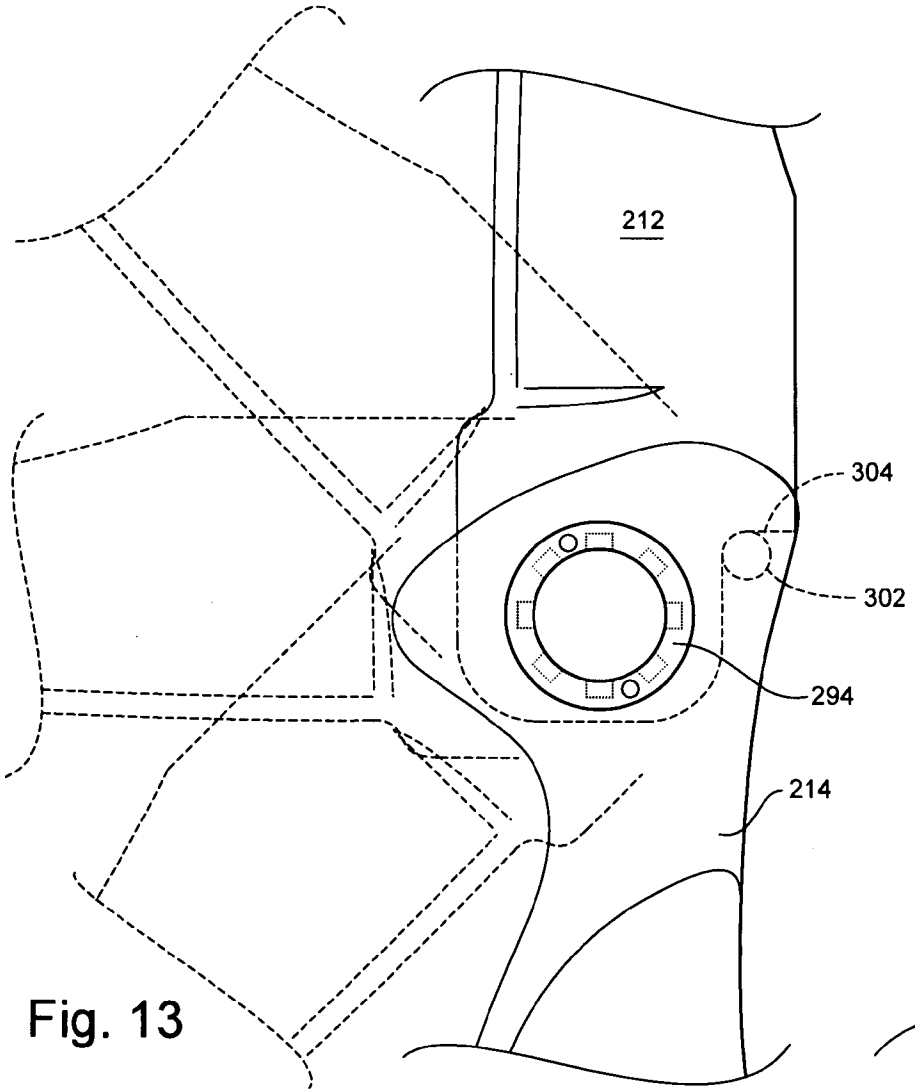
FIG. 13 is an enlarged side view of FIG. 11 showing a locking mechanism of the folding tool in greater detail.

FIGS. 11, 12, and 13 show the folding tool 210 in the assembled condition, with the tool blade 212 clamped tightly between the left and right frames 232 and 234 to prevent wobbling or lateral movement. An optional stop pin 302 extends laterally between the left and right frames 232 and 234 and engages an optional step 304 in the tang 218 to provide a bearing point for the tool blade 212 in a fully opened position. The left and right frames 232 and 234 are attached to each other by suitable means such as the plurality of struts 306.

In the locked position, shown in FIG. 14, the spring 290 urges the lock member 260 leftwards so that the release button 266 protrudes through the opening 296 in the retainer plate 294. The spline ribs 278 and spline grooves 280 of the spline ring 272 engage the spline slots 242 and spline teeth 244, respectively, of the left frame spline opening 240. The spline ribs 278 and spline grooves 280 of the spline ring 272 engage the spline slots 228 and spline teeth 230, respectively, of the tang spline opening 226, and also engage the spline slots 256 and spline teeth 254, respectively, of the right frame spline opening 252. In this condition, the tool blade 212 is solidly locked against pivoting motion in either the open or closed directions.

The tool blade 212 is released by depressing the release button 266, moving the lock member 260 to the right against the spring 290. This causes the spline ring 272 to disengage the left frame spline opening 240 and the tang spline opening 226. The cup 288 is made deep enough to accommodate this motion of the lock member 260. The spline teeth 230 of the tang opening 226 thus ride on the central shaft 270. In this condition a user can freely swing the tool blade 212 inwards or outwards to the desired position. The user keeps the release button 266 depressed until the tool blade 212 is disposed at or near the correct angular position, and then releases the release button 266. The spring 290 urges the lock member 260 leftwards. As the tool blade 212 is brought into alignment at the desired working position, the lock member 260 moves fully to the locked position, described above. The tool blade 212 is thus locked against any further pivoting motion until the release button 266 is again depressed, and the user may safely work with the folding tool 210 knowing that the tool blade 212 will neither open further nor close accidentally.

As shown in FIG. 10, the tool blade 212 can be locked in a number of different positions, denoted "A" through "D" and represented by dashed lines, in the same manner as for the folding tool 10 described above, and may also be locked in a fully closed position (not shown).

Figure 16:
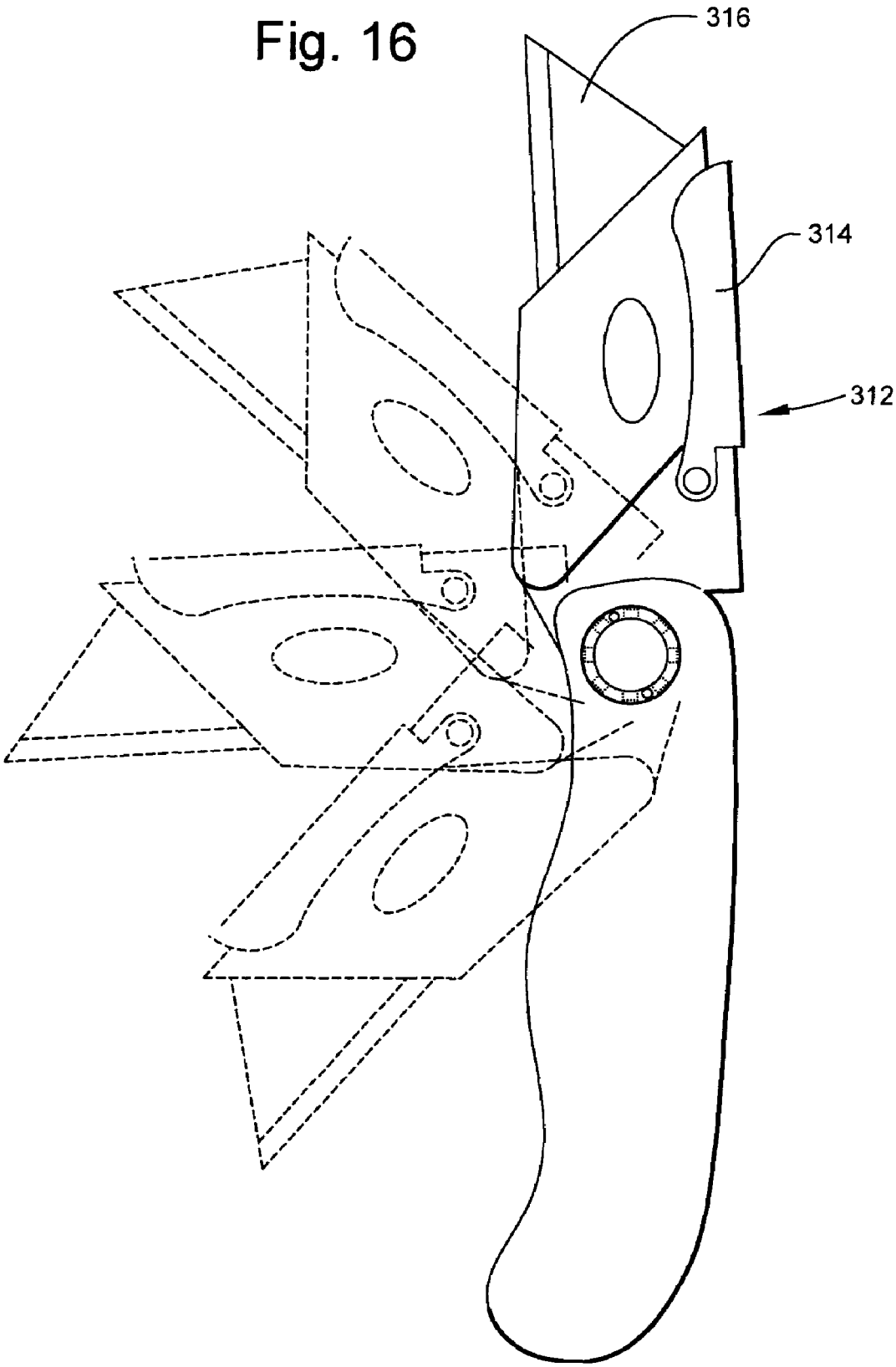
FIG. 16 is a side view showing an alternative tool blade for use with the present invention.
Figure 17:
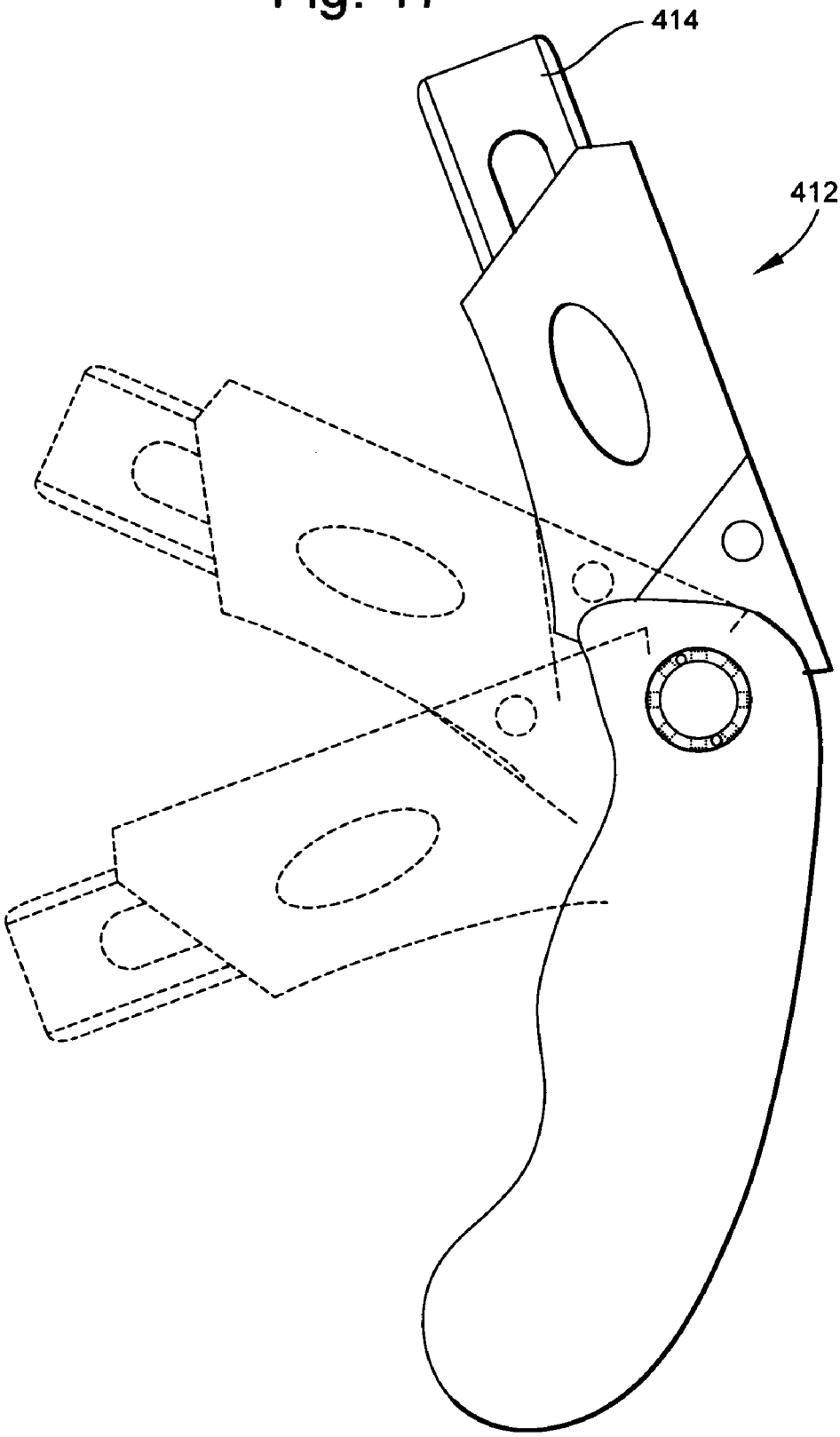
FIG. 17 is a side view showing another alternative tool blade for use with the present invention.
Figure 18:
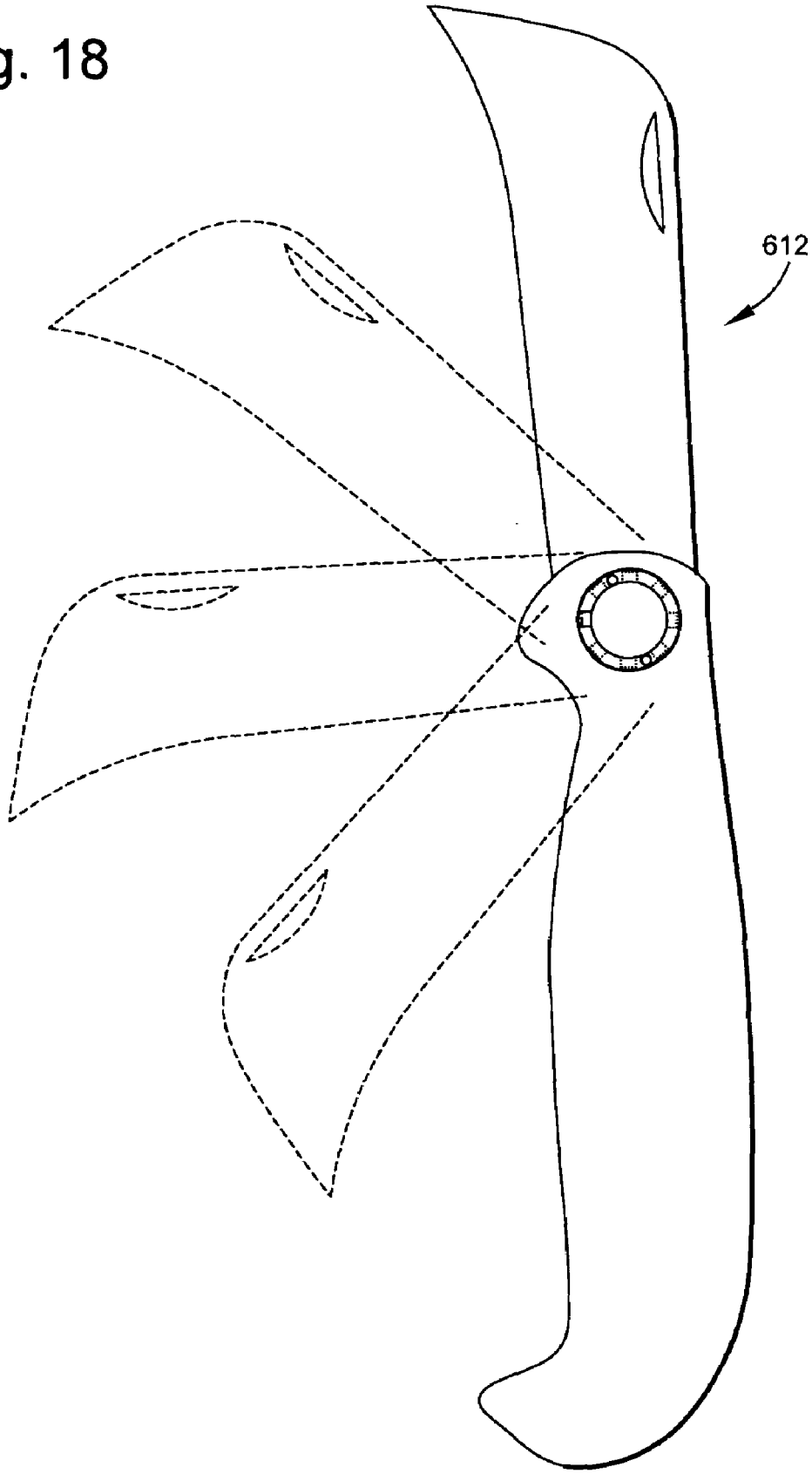
FIG. 18 is a side view showing yet another alternative tool blade for use with the present invention.

FIGS. 16, 17, and 18 depict variations of a tool blade, which are suitable for use with any of the folding tool embodiments 10, 110, or 210 described above. As can be seen, the tool blade need not be a cutting blade, but may be any tool useful for a working purpose. For example, FIG. 16 illustrates a tool blade 312 which includes a holder 314 for disposable, single-sided razor blades 316 of a known type. This kind of tool blade 312 may be useful for carpet-laying work and the like. FIG. 17 illustrates a general-purpose tool blade 412 having a stub 414 which can engage various tools such as a screwdriver, wrench, or the like. FIG. 18 illustrates yet another tool blade 612 in the form of a cutting blade so-called "sheep's-foot" profile.

Figure 19:
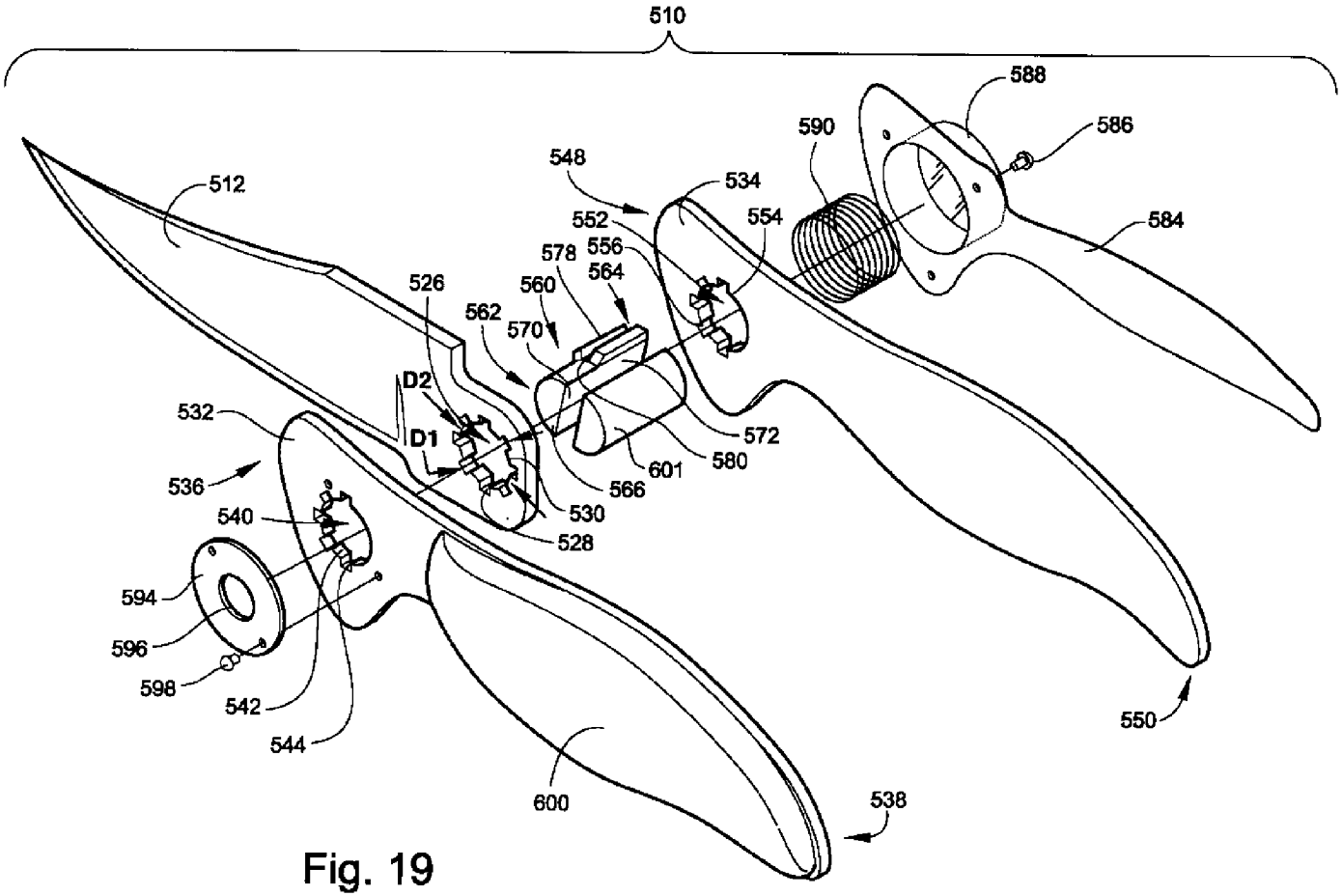
FIG. 19 is an exploded perspective view showing an alternative folding tool.

FIG. 19 illustrates another alternative folding tool 510. The folding tool 510 is substantially similar to the folding tool 210 described above and has a tool blade 512. It differs from the folding tool 210 principally in the design of the locking mechanism. In the illustrated example, the tool blade 512 is a knife blade including a tang spline opening 526 formed in the tang 518 thereof. The tang spline opening 526 includes a circumferential array of spline slots 528 which define an outer diameter D1. The tang spline slots 528 alternate with radially-inwardly extending tang spline teeth 530 that define an inner diameter D2.

The handle comprises left and right frames 532 and 534, respectively. The construction of the left and right frames 532 and 534 may be substantially similar in dimensions and material to prior art folding tools. For example, the left and right frames 532 and 534 may be formed from stamped or machined steel. The left frame 532 is generally planar and has a front end 536 and a rear end 538. The left frame 532 has a left frame spline opening 540 formed therein at the front end 536. The left frame spline opening 540 is substantially the same in size and shape to the tang spline opening 526, and includes alternating spline teeth 542 and spline slots 544. However, some portion of the left frame spline opening 540 is a continuous surface without any spline structure. In the illustrated example approximately one-half of the left frame spline opening 540 is a simple semi-circular shape.

The right frame 534 is generally planar and has a front end 548 and a rear end 550. The right frame 534 has a right frame spline opening 552 formed therein at the front end 548. The right frame spline opening 552 is substantially the same in size and shape to the tang spline opening 526, and includes spline teeth 554 and alternating spline slots 556. However, some portion of the right frame spline opening 552 is a continuous surface without any spline structure. In the illustrated example approximately one-half of the right frame spline opening 552 is a simple semi-circular shape.

A lock member 560 is provided which taken together is generally semi-cylindrical member having a left end 562 and a right end 564. The lock member 560 includes, in left-to-right order, a release button 566 disposed at the end of a central shaft 570, and a spline ring 572. The lock member 560 may be integrally formed from steel or a similar material. The central shaft 570 has an outer diameter slightly smaller than the inner diameter D2. The spline ring 572 includes a circumferential array of spline ribs 578 which define an outer diameter slightly smaller than the outer diameter D1. The spline ribs 578 alternate with radially-inwardly extending spline grooves 280 that define an inner diameter slightly smaller than the inner diameter D2. Chamfered surfaces, shown in exemplary form at 582, may be provided to ease operation of the lock member 560. A semi-cylindrical cross-shaft 601 is disposed next to the lock member 560 and has an outer diameter slightly smaller than the inner diameter D2.

The folding tool 510 is assembled as follows. The lock member 560 is inserted into the right frame 534 so that the spline ring engages the right spline opening 552. A right side plate 584 is attached to the outside of the right frame 534 with the illustrated rivets 586 or other suitable means. The right side plate 584 includes a cup 588 which covers the right spline opening 552 and retains a spring 590, such as the illustrated coil spring, between the right frame 534 and the right side plate 584.

The tang spline opening 526 of the tool blade 512 fits over the lock member 560. The left frame spline opening 540 fits over the lock member 560 as well. A retainer plate 594 fits over the outer surface of the left frame 532 to retain the lock member 560 in position. The retainer plate 594 is attached to the left frame 532 by the illustrated rivets 598 or other suitable means, and includes an opening therein 596 through which the release button 266 passes. A left side plate 600 is attached to the left frame 532 as well. It may be made of a material suitable for decorative or grip-enhancing purposes, such as rubber, plastic, wood, etc.

In this embodiment, the cross-shaft 601 engages the non-splined portions of the left and right frame spline openings 540 and 552, described above. It cooperates with the lock member 560 to form a shaft for the tool blade 512 to rotate above when the lock member is in the released position. However, the cross-shaft 601 does not move with the lock member 560. Thus, the user only depresses the lock member 560 in order to release the tool blade 512. The cross-member 601 serves to align the various components of the folding tool 510. If desired, it may also be used as a fastener to hold the folding tool 510 together. For example, the ends of the cross-shaft 601 may be made of a size selected to create an interference fit with the left and right frame spline openings 540 and 552, or it could be brazed to the left and right frames 532 and 534, or the ends of the cross-shaft 601 could be peened over the outsides of the frame spline openings in a fashion similar to a rivet.

The foregoing has described a folding tool. While specific embodiments of the present invention have been described, it will be apparent to those skilled in the art that various modifications thereto can be made without departing from the spirit and scope of the invention. For example, while the lock members 60, 160, and 260, the tool blade tang spline openings 26, 126, and 226, and the frame spline openings 40, 52, 152, 240, and 252 have all been depicted in the illustrated examples as having spline structures disposed around their full circumference, the spline structures may be formed only part way around one or more of these elements, so long as at least one pair of complementary spline elements are engaged in the desired locking positions such that the tool blade is prevented from rotation relative to the handle. Accordingly, the foregoing description of the preferred embodiment of the invention and the best mode for practicing the invention are provided for the purpose of illustration only and not for the purpose of limitation, the invention being defined by the claims.

What is claimed is:

1. A folding tool, comprising:

a handle comprising a pair of spaced-apart left and right frames each having front and rear ends, wherein at least one of said frames includes a frame spline opening disposed at said front end thereof, said spline opening having an annular array of alternate spline teeth and spline slots formed thereon, an elongated tool blade having a body and a tang, said tool blade having a tang spline opening formed therein which defines an annular array of alternate spline teeth and spline slots identical to said spline opening; and a transversely-extending lock member including:

at least one spline ring with an annular array of alternate spline ribs and spline grooves formed thereon complementary to said tang spline opening and said spline opening;

at least one central shaft having a cylindrical outer surface, wherein said lock member is disposed between said left and right frames such that said spline ring engages at least one of said frame spline openings;

wherein said lock member is translatable between a locked position and a released position;

a spring which urges said lock member towards said locked position, the spring being carried between said lock member and a side plate which covers said frame spline opening;

wherein said tool blade is attached to said handle by said lock member such that when said lock member is in said released position, said tool blade is freely pivotable about said central shaft of said lock member, and when said lock member is in said locked position, said spline ring engages said tang spline opening such that said tool blade is retained in one of a plurality of predetermined angular positions relative to said handle.

2. The folding tool of claim 1 wherein said tool blade is a knife blade having a cutting edge.

3. The folding tool of claim 1 wherein and each of said frames includes a frame spline opening having an annular array of alternate spline teeth and spline slots formed thereon complementary to said spline ring.

4. The folding tool of claim 3 wherein said spline ring of said lock member engages both of said frame spline openings when said lock member is in said locked position.

5. The folding tool of claim 3 wherein said locking member includes two spaced-apart spline rings each having an annular array of alternate spline ribs and spline grooves formed thereon complementary to said tang spline opening, wherein one of said spline rings engages one of said frame spline openings, and the other of said spline rings engages the other of said frame spline openings, when said lock member is in said locked position.

* * * * *